United States Patent [19]

Evensen

[11] Patent Number: 4,701,933

[45] Date of Patent: Oct. 20, 1987

[54] METHOD OF SUPPLYING HEAT ENERGY TO A METAL MELT OR THE LIKE AND A HEATING ELEMENT FOR USE WITH SAID METHOD

[75] Inventor: Cato Evensen, Fredrikstad, Norway

[73] Assignee: Scantherm A/S, Fredrikstad, Norway

[21] Appl. No.: 816,216

[22] Filed: Jan. 6, 1986

[30] Foreign Application Priority Data

Feb. 11, 1985 [NO] Norway ..... 850507
Jul. 11, 1985 [NO] Norway ..... 852786

[51] Int. Cl.[4] ..... H05B 3/10
[52] U.S. Cl. ..... 373/117; 373/127
[58] Field of Search ..... 373/117, 127; 219/553, 219/381

[56] References Cited

U.S. PATENT DOCUMENTS 2,356,237 8/1944 Geller .
2,735,881 2/1956 Mann .
4,351,057 9/1982 Biolik et al. ..... 373/117

FOREIGN PATENT DOCUMENTS 1056297 4/1959 Fed. Rep. of Germany .
2556399 6/1977 Fed. Rep. of Germany .
2706811 3/1979 Fed. Rep. of Germany .
1962584 7/1980 Fed. Rep. of Germany .
308933 3/1969 Sweden .
406567 3/1934 United Kingdom ..... 373/117
2012150A 7/1979 United Kingdom .
2014829A 8/1979 United Kingdom .

*Primary Examiner*—Roy N. Envall, Jr.
*Attorney, Agent, or Firm*—Holman & Stern

[57] ABSTRACT

The method according to the present invention relates to supply of heat energy to a metal melt or a similar electroconductive fluid (1,11). According to said method rod-like elements are partly immersed in the metal melt or a similar electroconductive fluid, the end portions (6,15) of said elements projecting from the melt are connected to electric power, and said end portions (6,15) and the other end portions (5,16) of said element consist of an electroconductive material, whereas the relatively long center portion (3, 13) of said element being immersed in the melt consists of electric resistance material, and at least said resistance material is coated with an electric insulating heat conductive and melt bath resistant coat (4, 14) which, thus, transfers the heat energy created in the resistance material of the elements to the melt.

The invention, furthermore, relates to a heating element for use with said method. Said heating element essentially consists of end portions (6,15) projecting from the melt for connection to electric power and consisting of a material that is a good electric conductor and of a longer center portion (3, 13) consisting of electric resistance material and being provided with a coat (4, 14) made from one or more oxides of metal and/or metalloids.

8 Claims, 3 Drawing Figures

METHOD OF SUPPLYING HEAT ENERGY TO A METAL MELT OR THE LIKE AND A HEATING ELEMENT FOR USE WITH SAID METHOD

BACKGROUND OF THE INVENTION

The present invention relates to a method of maintaining metal or the like in a melted state in a container by the aid of electric resistance heating. Furthermore, the invention relates to a heating element for use with said method.

It is previously known to supply energy to a metal melt by using electric resistance elements which may, in principle, be arranged in two different manners, i.e. either on top of the melt surface or in a tube or another sleeve-shaped body that is partly immersed in the metal melt. Conventional materials in such electric resistance elements are alloys of chrome-nickel and iron-aluminium, as well as e.g. silicon carbide, graphite, and molybdenium-silicon.

With the method comprising electric resistance elements provided on top of the metal melt surface, energy from said resistance elements is transferred to the metal melt by heat radiation onto the melt surface. This means that the container per se for the metal melt must be dimensioned with equal consideration to heat energy transfer and the space required by the actual production process. This will, in turn, result in a metal bath with a content of molten metal considerably larger than necessary for the production process per se. Due to this, much capital will be locked-up, e.g. as in the case of top heated galvanizing furnaces. Additional disadvantages of this method are that the resistance elements are not very resistant to metal spatter from the metal bath, and that any protection of the resistance elements against such metal spatter will result in reduced heat transfer from said elements to the metal melt.

In another known method the metal element is supplied with energy by heating elements/resistance elements, preferably shaped as rods, and provided in a tube with a bottom or in another sleeve-shaped body that is partly immersed in the metal melt, and where there is no electroconductive contact between the resistance element(s) and said sleeve. With this method heat is transferred by radiation from the resistance element to said sleeve from which heat conduction occurs in the metal melt.

Heating elements of the above kind are disclosed, inter alia in U.K. No. 1 027 163 and U.S. Pat. No. 4 132 886. Said sleeves may be manufactured from different kinds of material. When the material comprises metal alloys the sleeve temperature will be limited to a relatively low level, causing a reduction of the amount of energy transfer that could otherwise be utilized from said resistance elements. Another disadvantage of metal alloys is that they are not very resistant to metal melts, e.g. from zinc and aluminium. Tubes or sleeves made from a material based on, e.g. graphite, silicon carbide, silicon nitride, or aluminium nitride resist higher temperatures, and may also be resistant to molten metals. In practice, however, it proved difficult to achieve a satisfactory tight tube or sleeve in said materials. This will, inter alia, result in the fact that the outer tube or sleeve surface facing the metal melt is subjected to oxygen resulting in an oxidation of said outer surface and/or the molten metal adjacent said outer surface. The oxide layer, so, formed has a heat insulating effect and will, thus, reduce the amount of transferred energy. Another disadvantage of such tubes or sleeves is that the heat exchange constancy may be poor.

BRIEF DESCRIPTION OF THE DRAWINGS

According to the present invention a new method of supplying a metal bath or a similar electrically conductive fluid with heat energy is provided which eliminates the above mentioned disadvantages of the known technology of the art to a considerable degree. The present method is essentially characterized in that rod-like elements are partly immersed in the metal melt or a similar electroconductive fluid, the end portions of said rod like elements projecting from the bath are connected to electric power, where said end portions and the other end portions of said elements consist of an electroconductive material, whereas the relatively long central portion of said elements, being immersed in the bath or the like, consist of electric resistance material, and where at least said resistance material is coated with an electric insulating heat conductive and metal melt resistant coat, thus, transferring the heat energy created in the resistance material of said elements to the metal bath.

According to the invention a new kind of heat element is, also, provided, the characterizing feature of which essentially is that the portion immersed in the metal bath and consisting of electric resistance material conventional per se is coated with an electric insulating, heat conductive and metal melt resistant coat consisting of one or more oxides of metals and/or metalloids. Other features of the heat elements will appear from the following claims.

The electric resistance material of the elements may be of a conventional kind, and in metal baths, e.g. in a zinc bath or an aluminium bath, the electric resistance material is preferably a semi-conductor material on the basis of graphite or silicon carbide. In principle the coating material should be a material showing high insulating capability, good heat conductivity, high heat exchange tolerance, high temperature tolerance, and high resistance to the metal bath. Materials that are suitable in this connection are materials essentially consisting of oxides of metals and/or metalloids, preferably oxides of aluminium, zinc, zirconium, silicon, and magnesium. The material of the end portions of the rod-like element arms, the so called cold ends, may in principle consist of any highly electroconductive material resistant under the prevailing conditions. If the rod-like elements are joined the joining material may consist of an electric resistance material, e.g. the same material as that of the rod-like arms, or it may consist of a highly electroconductive material, e.g. the same material as that of the so called cold ends of the heating element.

The heating element according to the present invention is immersed in the molten metal in such a manner that only the end portions of the rod-like element arms being provided with a coat to a certain level above the metal bath will project from said metal bath. When the ends of the elements projecting from the bath are connected to a source of power the immersed portion of the elements essentially consisting of said electric resistance material and a coating, form the hot zone of the elements. With this kind of heating element the metal bath is supplied with heat energy by direct heat conduction.

BRIEF DESCRIPTION OF THE DRAWINGS

Figure 1:
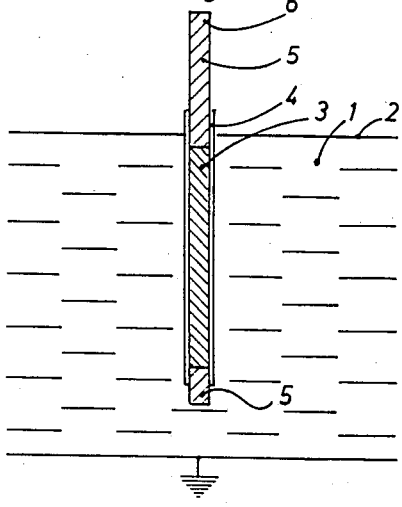
Figure 2:
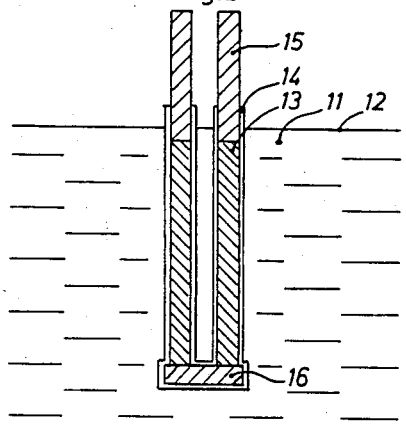
Figure 3:
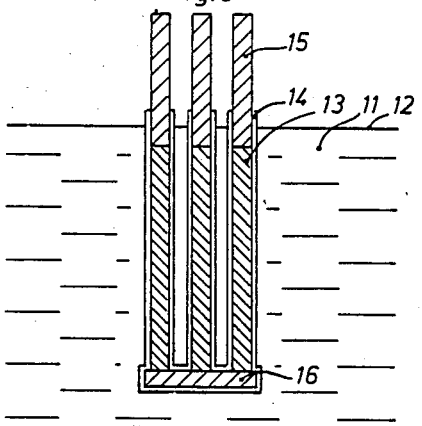

The present invention will now be disclosed in more detail with reference to three embodiments shown in associated figures of the drawing, wherein FIG. 1 is a sectional view of a rod-like heating element partly immersed in a metal bath;

FIG. 2 is a sectional view of a two-armed heating element partly immersed in a metal bath; and FIG. 3 is a sectional view of a three-armed heating element partially immersed in a metal bath.

DETAILED DESCRIPTION OF THE INVENTION

In FIG. 1 a metal bath is designated 1 and the surface of said bath is designated 2. A heating element is immersed in said metal bath 1, and said heating element consists of a core 3 of silicon carbide showing relatively high electric resistance. At both ends of said silicon carbide rod 3 end portions 5 are provided, said end portions also consisting of a silicon carbide material but in a crystalline form which renders said material a good electrical conductor. Said two end portions 5 are called the cold ends of the heating elements. The entire core 3 and part of the so called cold ends are coated with a coat 4 essentially consisting of aluminium oxide and silicon oxide. The source of power (not shown) is connected to the heating element at an upper portion 6 of cold end 5. It will appear that the hot zone of said heating element is provided by the portion of the element containing the core 3. When said heating element is connected to a source of power an electric connection will, thus, be established via the metal bath between the lower cold end of the heating element and, e.g. a neutral electrode. Thus, there will be a certain voltage difference between the two cold ends of the heating element. Due to the fact that the coat forms an electrical insulation against the liquid metal said voltage difference will be converted into heat energy in the hot zone of said heating element, said zone showing high electric resistance.

In FIGS. 2 and 3 a metal bath is designated 11 and 12 designates the surface of said bath. The rod-like arms consist of resistance material 13, in the present embodiment being silicon carbide, and 15 designates the cold end here formed from silicon carbide, but in a crystalline form rendering the material a good electric conductor. The rod-like arms are joined into electroconductive connections by the aid of a connecting member 16, in the present embodiment made from the same material as the cold ends 15. The coating material 14 in the present case consisting essentially of aluminium oxide and silicon oxide, covers the entire immersed portion of the element as well as part of the cold ends 15 projecting from the bath. In the embodiment shown in FIGS. 2 and 3 those portions of the cold ends provided below and immediately above the surface of the metal bath are provided with coating material.

The source of power, not shown in FIGS. 2 and 3, is connected with the end portions 15 projecting from the bath. The hot zone of the heating elements, as shown, consists of the portion of the heating element where the electric resistance material is provided.

I claim:

1. A method for supplying heat only to a metal melt, comprising the steps of:

(a) providing a metal melt;

(b) supplying a core which is composed of an electrically resistive material which is capable of withstanding temperatures exceeding the melting point of a metal to which heat is to be supplied;

(c) providing a means for conducting electricity to said core;

(d) providing a means for conducting electricity from same core;

(e) coating said core with a coating which is electrically insulating and which has a relatively high heat conducting capacity; and (f) immersing said core of step (e) in the metal melt.

2. A method as claimed in claim 1, wherein in step (b), said core is composed of silicon carbide;

in step (c), said means for conducting electricity to said core being provided as a crystaline form of silicon carbide; and in step (e), said coating being provided as aluminum oxide and silicon oxide.

3. An apparatus for providing heat energy only while immersed in a metal melt comprising:

a core, said core being composed of an electrically resistive material;

a means for conducting electricity through said core to cause electrically resistive heating of said core;

and a coating on said core, said coating being electrically insulating, heating conductive, and metal resistant;

said coating being selected from a group including one or more oxides of metals and/or metalloids.

4. An apparatus as claimed in claim 3, wherein said coating comprises aluminum oxide and silicon oxide.

5. An apparatus as claimed in claim 4, wherein said core comprises at least two elongated bodies.

6. An apparatus as claimed in claim 5, wherein said two elongated bodies are non-colinear, and which are connected together by an electrically-conductive member.

7. An apparatus as claimed in claim 5, wherein said core includes three elongated bodies which are connected together by electrically conducting members, and wherein said three bodies are mutually non-colinear.

8. A heating element for supplying heat energy only while immersed in a metal melt, comprising:

an elongated core; said core being composed of silicon carbide, and being electrically resistive;

an upper end portion connected to an upper portion of said core, and a lower end portion connected to a lower portion of said core; said upper end portion and said lower end portion being composed of silicon carbide in crystalline form; said silicon carbide in crystalline form being a relatively good conductor of electricity and of relatively low electrical resistance compared to said core; and a coating on said core composed of a mixture of two or more oxides selected from the group including aluminum, zirconium, silicon, and magnesium.

* * * * *